US007287643B1

(12) United States Patent
Glover, Sr.

(10) Patent No.: US 7,287,643 B1
(45) Date of Patent: Oct. 30, 2007

(54) TOOTH CARE DEVICE, KIT AND METHOD OF USE

(76) Inventor: Larry D. Glover, Sr., 435 Lake Amberleigh Dr., Winter Garden, FL (US) 34787

( * ) Notice: Subject to any disclaimer, the term of this patent is extended or adjusted under 35 U.S.C. 154(b) by 196 days.

(21) Appl. No.: 11/041,684

(22) Filed: Jan. 21, 2005

(51) Int. Cl.
*B65D 73/00* (2006.01)

(52) U.S. Cl. ..... 206/63.5; 206/471; 206/223

(58) Field of Classification Search ..... 206/63.5, 206/368, 471, 800, 83, 581, 223, 461; 424/451, 424/2, 463, 467
See application file for complete search history.

(56) References Cited

U.S. PATENT DOCUMENTS

| | | | | | |
|---|---|---|---|---|---|
| 2,004,957 | A | | 6/1935 | Messner | |
| 2,778,045 | A | | 1/1957 | Bly et al. | |
| 3,431,339 | A | * | 3/1969 | Bouchal et al. | 424/52 |
| 3,929,988 | A | * | 12/1975 | Barth | 424/54 |
| 4,427,116 | A | * | 1/1984 | Brown | 206/530 |
| 5,057,305 | A | * | 10/1991 | Aberg | 424/44 |
| 5,433,952 | A | | 7/1995 | Sipos | |
| 5,549,204 | A | * | 8/1996 | Toren | 206/539 |
| D391,399 | S | * | 3/1998 | Mills | D4/108 |
| 6,086,372 | A | * | 7/2000 | Diamond | 433/216 |
| D434,137 | S | | 11/2000 | Davis | |
| 6,155,423 | A | * | 12/2000 | Katzner et al. | 206/531 |
| 6,321,944 | B1 | * | 11/2001 | Cetrangolo | 222/105 |
| 6,447,755 | B1 | * | 9/2002 | Ballard | 424/49 |
| 6,524,023 | B2 | | 2/2003 | Andersen | |
| 7,074,390 | B2 | * | 7/2006 | MacKinnon | 424/49 |
| 2003/0211053 | A1 | * | 11/2003 | Szeles et al. | 424/50 |
| 2004/0022747 | A1 | * | 2/2004 | Fisher et al. | 424/52 |

* cited by examiner

*Primary Examiner*—Mickey Yu
*Assistant Examiner*—Steven A. Reynolds

(57) ABSTRACT

A tooth care device, a kit for a tooth care device and an associated method of using same are described for providing a convenient and hygienic way of transporting and using a tooth care product. The device includes a base, a gelcap, and a cover. The base has a plurality of hollow wells in which each gelcap is sequestered within each hollow well of the base. Each gelcap has an outer shell and an inner toothpaste core. The cover is attached over the base so that the plurality of gelcaps is hermetically sealed within the device. The kit includes the device and a toothbrush. The method includes the steps of bending, brushing, expectorating, grasping, inserting, obtaining, pealing, placing, pinching, pressing, removing, rinsing, taking, transporting, tearing, and withdrawing.

20 Claims, 3 Drawing Sheets

TOOTH CARE DEVICE, KIT AND METHOD OF USE

FIELD OF THE INVENTION

The present invention relates to dental hygiene, more particularly to a tooth care device, a kit for the tooth care device, and an associated method of using same for providing a convenient and hygienic means of transporting and using a tooth care device.

BACKGROUND OF THE INVENTION

A wide variety of tooth care devices is currently available on the commercial market and an even larger number of these types of devices are known in the art of tooth care devices, for example, the capsule disclosed by Messner in U.S. Pat. No. 2,004,957; the dentifrice-containing capsules disclosed by Bly et al. in U.S. Pat. No. 2,778,045; the denitrifice encapsulation disclosed by Brown in U.S. Pat. No. 4,427,116; the intraoral medicament-releasing device disclosed by Sipos in U.S. Pat. No. 5,433,952; the single use toothpaste dispensing device and disposable toothbrush kit utilizing same disclosed by Anderson in U.S. Pat. No. 6,254,023; and the toothpaste capsule disclosed by Davis in U.S. Pat. No. D434,137.

While all of the above-described devices fulfill their respective, particular objectives and requirements, the aforementioned patents do not describe a tooth care device having a base, a gelcap, and a cover in which the base has a plurality of hollow wells so that each gelcap is sequestered within each hollow well of the base and hermetically sealed with the cover, wherein each gelcap has an outer shell and an inner toothpaste core. This combination of elements would specifically match the user's particular individual needs of making it possible to provide a convenient and hygienic means of transporting and using a tooth care device. The above-described patents make no provision for a convenient and hygienic means of transporting and using a tooth care device.

Therefore, a need exists for a new and improved tooth care device having a base, a gelcap, and a cover in which the base has a plurality of hollow wells so that each gelcap is sequestered within each hollow well of the base and hermetically sealed with the cover, wherein each gelcap has an outer shell and an inner toothpaste core. In this respect, the tooth care device according to the present invention substantially departs from the conventional concepts and designs of the prior art, and in doing so provides an apparatus primarily developed for the purpose of providing a convenient and hygienic means of transporting and using a tooth care device.

SUMMARY OF THE INVENTION

The present device, kit and method of using, according to the principles of the present invention, overcomes the shortcomings of the prior art by providing a novel and nonobvious tooth care device, kit and method of using the same. The device includes a base, a gelcap, and a cover. The base has a plurality of hollow wells in which each gelcap is sequestered within each hollow well of the base. Each gelcap has an outer shell and an inner toothpaste core. The cover is attached over the base so that the plurality of gelcaps is hermetically sealed within the device. The kit includes the device and a toothbrush. The method includes the steps of bending, brushing, expectorating, grasping, inserting, obtaining, pealing, placing, pinching, pressing, removing, rinsing, taking, transporting, tearing, and withdrawing.

In view of the foregoing disadvantages inherent in the known type tooth care devices now present in the prior art, the present invention provides an improved tooth care device, which will be described subsequently in great detail, is to provide a new and improved tooth care device which is not anticipated, rendered obvious, suggested, or even implied by the prior art, either alone or in any combination thereof.

To attain this, the present invention essentially comprises a base, a gelcap, and a cover. The base has a plurality of hollow wells in which each gelcap is sequestered within each hollow well of the base. Each gelcap has an outer shell and an inner toothpaste core. The cover is attached over the base so that the plurality of gelcaps is hermetically sealed within the device.

There has thus been outlined, rather broadly, the more important features of the invention in order that the detailed description thereof that follows may be better understood, and in order that the present contribution of the art may be better appreciated.

The invention may also include a plurality of serrated lines traversing through the base which subdivide the base. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tooth care device that has all the advantages of the prior art tooth care device and none of the disadvantages.

It is another object of the present invention to provide a new and improved tooth care device that may be easily and efficiently manufactured and marketed.

An even further object of the present invention is to provide a new and improved tooth care device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new tooth care device that provides in the apparatuses and methods of the prior art some of the advantages thererof, while simultaneously overcoming some of the disadvantages normally associated therewith.

Even still another object of the present invention is to provide a tooth care device having a base, a gelcap, and a cover in which the base has a plurality of hollow wells so that each gelcap is sequestered within each hollow well of the base and hermetically sealed with the cover, wherein each gelcap has an outer shell and an inner toothpaste core. This combination of elements makes it possible to provide a convenient and hygienic means of transporting and using a tooth care device.

Still another object of the present invention is to provide a kit comprising the unassembled components of the device.

Lastly, it is an object of the present invention to provide a new and improved method of using comprising the steps of bending, brushing, expectorating, grasping, inserting, obtaining, pealing, placing, pinching, pressing, removing, rinsing, taking, transporting, tearing, and withdrawing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
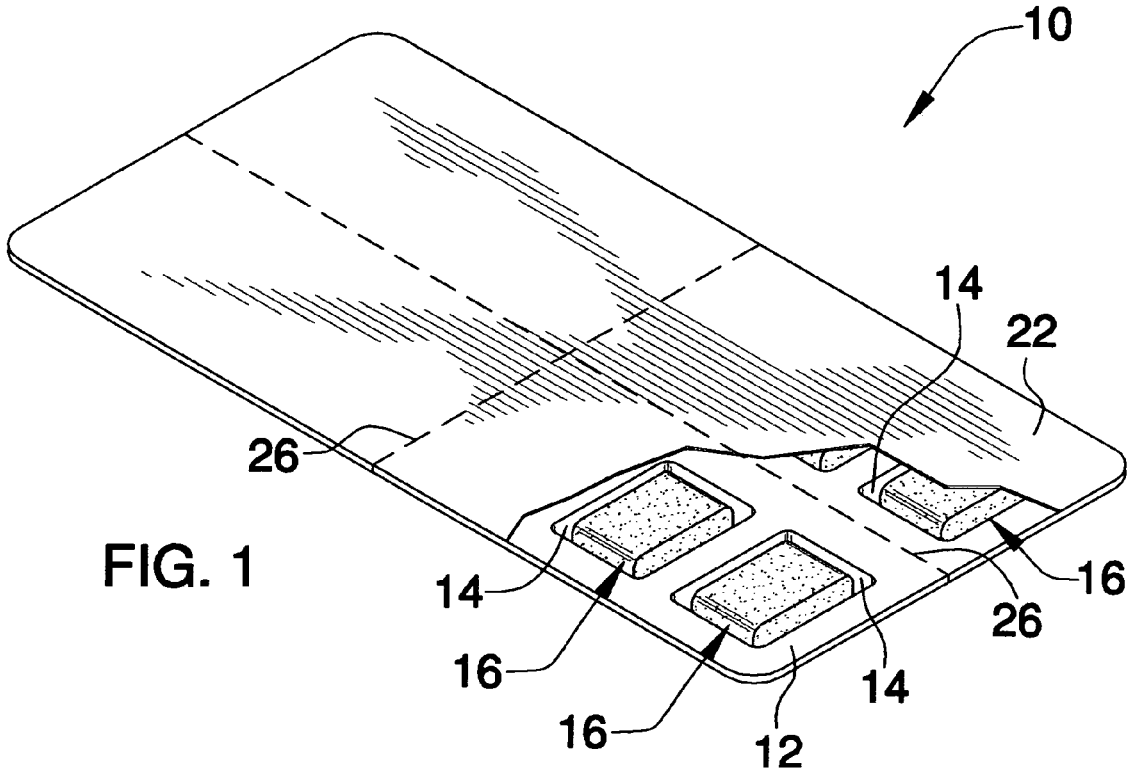
FIG. 1 is a perspective view of an preferred embodiment of the tooth care device constructed in accordance with the principles of the present invention.
Figure 2:
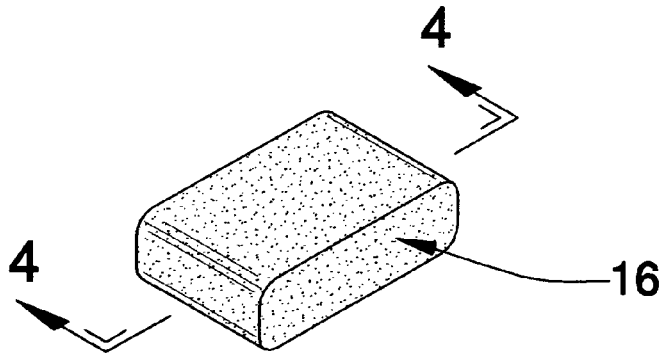
FIG. 2 is a perspective view of a preferred embodiment of one of the gelcaps of the tooth care device of the present invention.
Figure 3:
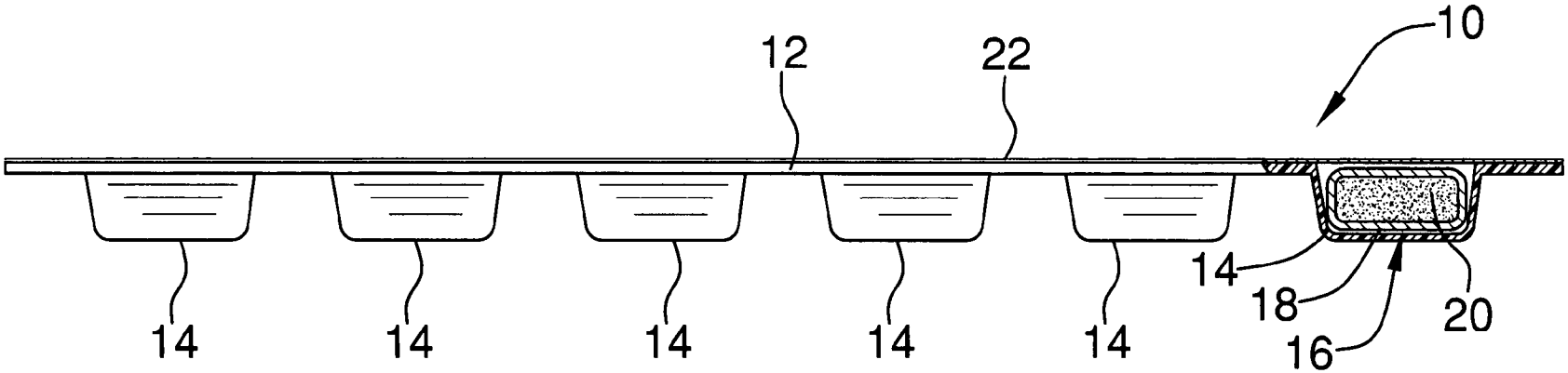
FIG. 3 is a side view of partial cross section of a preferred embodiment of the tooth care device of the present invention.
Figure 4:
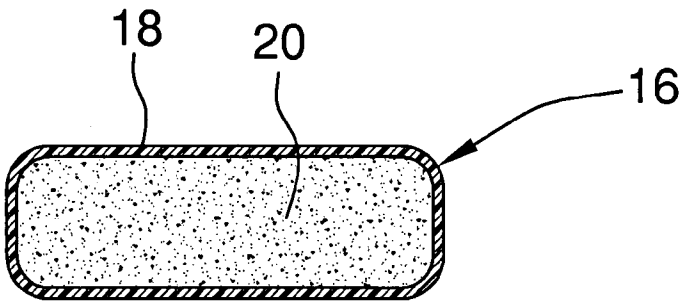
FIG. 4 is a side cross sectional view of a gelcap of a preferred embodiment of the tooth care device of the present invention.
Figure 5:
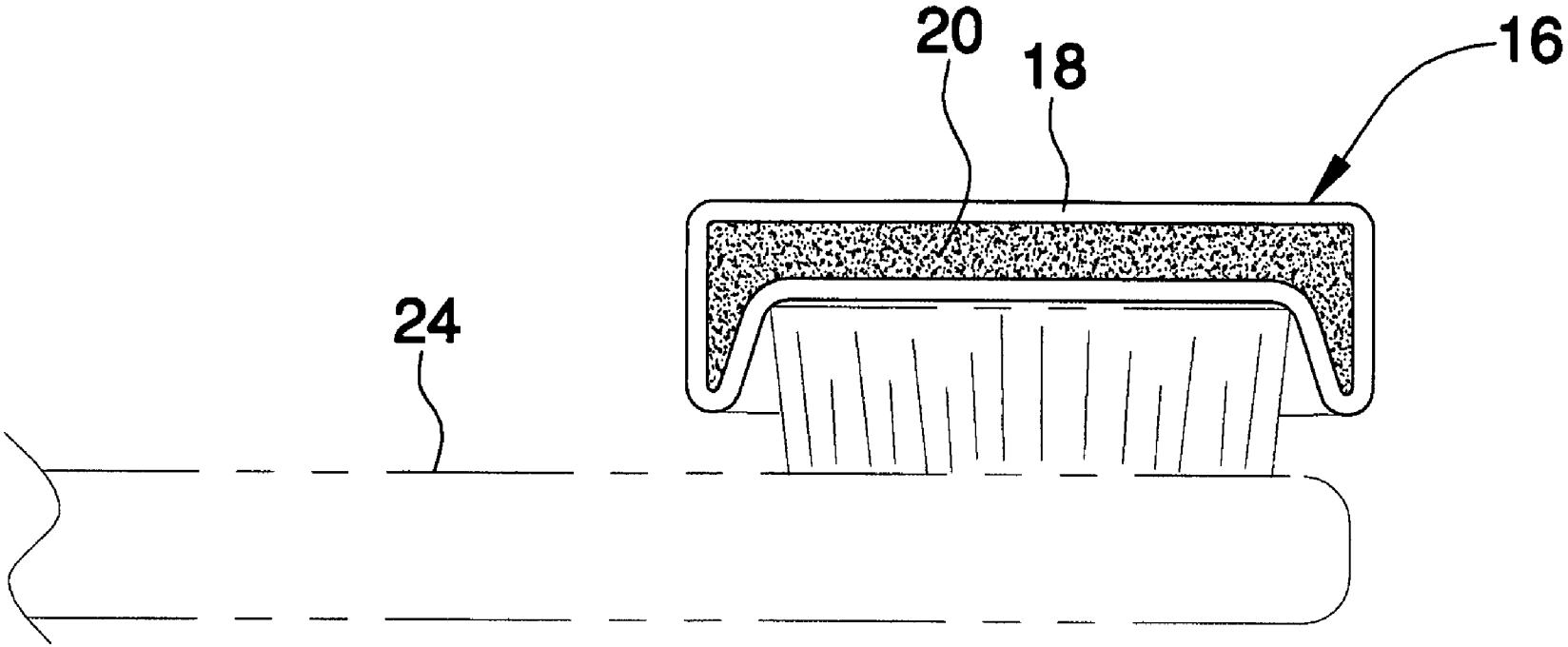
FIG. 5 is a side cross sectional view of a gelcap pressed into a toothbrush of a preferred embodiment of the tooth care device of the present invention.

Referring now to the drawings, and in particular FIGS. 1 to 5 thereof, one preferred embodiment of the present invention is shown and generally designated by the reference numeral 10. One preferred embodiment of a tooth care device 10 comprises a base 12, a plurality of gelcaps 16, and a cover 22. The base 12 has a plurality of hollow wells 14. The each gelcap of the plurality of gelcaps 16 is sequestered within each hollow well 14 of the base 12. Each gelcap 16 has an outer shell 18 and an inner toothpaste core 20. The cover 22 is attached to the base 12, in which the cover 22 and the base 12 hermetically seal the plurality of gelcaps 16.

An optional toothbrush 24 may be added to the device 10.

An optional plurality of serrated lines 26 may be added to the device in which the plurality of serrated lines 26 subdivides the base 12 into a plurality of subunits.

The base 12 of the device 10 may be made of any commercially available material, in which one preferred configuration is that the base 12 is made of plastic selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The cover 22 may be made of any commercially available material, in which one preferred configuration is that the cover 22 is a thin foil cover 22.

The inner toothpaste core 20 may be made of any commercially available material, in which one preferred configuration is that the inner toothpaste core 20 comprises a flavoring agent selected from the group consisting of apple, orange, cherry, vanilla, watermelon, bubble gum, apricot, grape, currant, lemon, and mixtures thereof. Another preferred configuration is that the inner toothpaste core 20 comprises a breath enhancement agent selected from the group consisting of oil of peppermint, oil of wintergreen, oil of spearmint, oil of clove, oil of sassafras, and mixtures thereof. Still another preferred configuration is that the inner toothpaste core 20 comprises a thickening agent selected from the group consisting of carboxyvinyl polymers, xanthan gum, carrageenan, sodium carboxymethyl cellulose, sodium carboxymethyl hydroxyethyl cellulose, hydroxyethyl cellulose, and mixtures thereof. Yet another preferred configuration is that the inner toothpaste core 20 comprises a sudsing agent selected from the group consisting of non-soap anionic detergents, nonionic detergents, cationic detergents, zwitterionic detergents, amphoteric organic synthetic detergents, and mixtures thereof. Still yet another preferred configuration is that the inner toothpaste core 20 comprises a polishing agent selected from the group consisting of chalk, silica, alumina, zirconium silicate, sodium aluminosilicate, sodium monofluorophosphate and alumina trihydrate abrasive, alkali aluminum silicate zeolite and mixtures thereof. Even still yet another preferred configuration is that the inner toothpaste core 20 comprises a humectant selected from the group consisting of glycerine, sorbitol, xylitol, and mixtures thereof. Yet another preferred configuration is that the inner toothpaste core 20 comprises a fluoride anion source selected from the group consisting sodium fluoride, potassium fluoride, ammonium fluoride, zinc fluoride, germanium fluoride, palladium fluoride, titanium fluoride, sodium fluorozirconate, potassium fluorozirconate, stannous fluorozirconate, stannous fluoroborate, stannous fluorosulfate, sodium fluorosulfate, potassium fluorosulfate, calcium fluorosulfate, and mixtures thereof. Still another preferred configuration is that the inner toothpaste core 20 comprises a sweetening agent selected from the group consisting of saccharin, dextrose, levulose, aspartame, D-tryptophan, dihydrochalcones, sodium cyclamate, sucrose, fructose, glucose, and mixtures thereof. Still yet another preferred configuration is that the inner toothpaste core 20 comprises a buffering agent sufficient to maintain the pH in the range of about 6.0 to 8.0. Even still another preferred configuration is that the inner toothpaste core 20 comprises a whitening agent, such as hydrogen peroxide. Still another preferred configuration is that the inner toothpaste core 20 comprises an anti-plaque agent, such as zinc citrate, sanguinarine, baking soda, hydrogen peroxide and mixtures thereof. Yet another preferred configuration is that the inner toothpaste core 20 comprises a desensitizing agent selected from the group consisting of strontium chloride, potassium nitrate, sodium citrate and mixtures thereof.

The outer shell 18 of the gelcap 16 may be made of any commercially available material in which one preferred configuration is that the outer shell 18 is dissolvable upon contact with saliva.

One preferred embodiment of a kit for a tooth care device 10 comprises a base 12 having a plurality of hollow wells 14; a plurality of gelcaps 16, each gelcap 16 is sequestered within each hollow well 14 of the base 12, wherein each gelcap 16 having an outer shell 18 and an inner toothpaste core 20; a cover 22 attached to the base 12, wherein the cover 22 and the base 12 hermetically sealing the plurality of gelcaps 16 and a toothbrush 24.

One preferred embodiment of a method of using a kit for a tooth care device 10 comprises the steps of bending, brushing, expectorating, grasping, inserting, obtaining, pealing, placing, pinching, pressing, removing, rinsing, taking, transporting, tearing, and withdrawing. The obtaining step comprises obtaining the kit comprising a base 12 having a plurality of hollow wells 14; a plurality of gelcaps 16, each gelcap 16 is sequestered within each hollow well 14 of the base 12, wherein each gelcap 16 having an outer shell 18 and an inner toothpaste core 20; a cover 22 attached to the base 12, wherein the cover 22 and the base 12 hermetically sealing the plurality of gelcaps 16; a plurality of serrated line subdividing the base 12; and a toothbrush 24. The placing step comprises placing the kit within a pocket. The transporting step comprises transporting the kit to a washroom facility. The taking step comprises taking out the kit from the pocket. The bending step comprises bending the base 12 along one of the serrated lines 26, wherein the bending step performed subsequent to the taking step. The tearing step comprises tearing the base 12 along the bent serrated line wherein the tearing step performed subsequent to the bending step. The pinching step comprises pinching onto the cover 22 with two fingers. The pealing step comprises pealing off a portion of the cover 22 while pinching onto the cover 22 to expose one gelcap 16 sequestered within one hollow well 14 of the base 12. The removing step comprises removing the exposed gelcap 16 from the base 12. The grasping step comprises grasping onto the toothbrush 24. The pressing step comprises pressing the exposed gelcap 16 onto the toothbrush 24. The inserting step comprises inserting a portion of the toothbrush 24 with the gelcap 16 pressed onto the toothbrush 24 within a mouth of a user. The brushing step comprises brushing a plurality of teeth within the mouth of the user with the inserted portion of the toothbrush 24 wherein the brushing step performed subsequent to the inserting step. The expectorating step comprises expectorating any excess saliva wherein the expectorating step performed subsequent to the brushing step. The withdrawing step comprises withdrawing the portion of the toothbrush 24 from the mouth of the user, wherein the withdrawing step performed subsequent to the brushing step. The rinsing step comprises rinsing the withdrawn toothbrush 24 with water.

As to the manner of usage and operation of the present invention, the same should be apparent from the above description. Accordingly, no further discussion relating to the manner of usage and operation will be provided.

While a preferred embodiment of the tooth care device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A tooth care device comprising a base having a plurality of hollow wells;

a plurality of gelcaps, each gelcap is sequestered within each hollow well of said base, wherein each gelcap having an outer shell having a top, opposing sides, opposing ends, and a bottom and an inner toothpaste core;

a plurality of toothbrush receivers, wherein said bottom of each gelcap defines a hollow therein to comprise said toothbrush receivers; and a cover attached to said base, wherein said cover and said base hermetically sealing said plurality of gelcaps.

2. The device of claim 1 further comprising a toothbrush.

3. The device of claim 1 further comprising a plurality of serrated lines subdividing said base.

4. The device of claim 1 wherein said base is made of plastic selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

5. The device of claim 1 wherein said cover is a thin foil cover.

6. The device of claim 1 wherein said inner toothpaste core comprising a flavoring agent selected from the group consisting of apple, orange, cherry, vanilla, watermelon, bubble gum, apricot, grape, currant, lemon, and mixtures thereof.

7. The device of claim 1 wherein said inner toothpaste core comprising a breath enhancement agent selected from the group consisting of oil of peppermint, oil of wintergreen, oil of spearmint, oil of clove, oil of sassafras, and mixtures thereof.

8. The device of claim 1 wherein said inner toothpaste core comprising a thickening agent selected from the group consisting of carboxyvinyl polymers, xanthan gum, carrageenan, sodium carboxymethyl cellulose, sodium carboxymethyl hydroxyethyl cellulose, hydroxyethyl cellulose, and mixtures thereof.

9. The device of claim 1 wherein said inner toothpaste core comprising a sudsing agent selected from the group consisting of non-soap anionic detergents, nonionic detergents, cationic detergents, zwitterionic detergents, amphoteric organic synthetic detergents, and mixtures thereof.

10. The device of claim 1 wherein said inner toothpaste core comprising a polishing agent selected from the group consisting of chalk, silica, alumina, zirconium silicate, sodium aluminosilicate, sodium monofluorophosphate and alumina trihydrate abrasive, alkali aluminum silicate zeolite and mixtures thereof.

11. The device of claim 1 wherein said inner toothpaste core comprising a humectant selected from the group consisting of glycerine, sorbitol, xylitol, and mixtures thereof.

12. The device of claim 1 wherein said inner toothpaste core comprising a fluoride anion source selected from the group consisting sodium fluoride, potassium fluoride, ammonium fluoride, zinc fluoride, germanium fluoride, palladium fluoride, titanium fluoride, sodium fluorozirconate, potassium fluorozirconate, stannous fluorozirconate, stannous fluoroborate, stannous fluorosulfate, sodium fluorosulfate, potassium fluorosulfate, calcium fluorosulfate, and mixtures thereof.

13. The device of claim 1 wherein said inner toothpaste core comprising a sweetening agent selected from the group consisting of saccharin, dextrose, levulose, aspartame, D-tryptophan, dihydrochalcones, sodium cyclamate, sucrose, fructose, glucose, and mixtures thereof.

14. The device of claim 1 wherein said inner toothpaste core comprising a buffering agent sufficient to maintain the pH in the range of about 6.0 to 8.0.

15. The device of claim 1 wherein said inner toothpaste core comprising a whitening agent.

16. The device of claim 1 wherein said inner toothpaste core consisting of an anti-plaque agent selected from the group comprising zinc citrate, sanguinarine, baking soda, hydrogen peroxide and mixtures thereof.

17. The device of claim 1 wherein said inner toothpaste core comprising a desensitizing agent selected from the group consisting of strontium chloride, potassium nitrate, sodium citrate and mixtures thereof.

18. The device of claim 1 wherein said outer shell is dissolvable upon contact with saliva.

19. A kit for a tooth care device comprising a base having a plurality of hollow wells;

a plurality of gelcaps, each gelcap is sequestered within each hollow well of said base, wherein each gelcap having an outer shell having a top, opposing sides, opposing ends, and a bottom and an inner toothpaste core;

a plurality of toothbrush receivers, wherein said bottom of each gel cap defines a hollow therein to comprise said toothbrush receivers;

a cover attached to said base, wherein said cover and said base hermetically sealing said plurality of gelcaps; and a toothbrush having a brush head having a top, opposing sides, and opposing ends, wherein when said brush head is inserted into said toothbrush receiver of one of said gel caps, said opposing sides and said opposing ends of said outer shell wraparound said top, opposing sides, and opposing ends of said brush head.

20. A method of using a kit for a tooth care device comprising the steps of:

obtaining the kit comprising a base having a plurality of hollow wells;

a plurality of gelcaps, each gelcap is sequestered within each hollow well of said base, wherein each gelcap having an outer shell and an inner toothpaste core;

a cover attached to said base, wherein said cover and said base hermetically sealing said plurality of gelcaps;

a plurality of serrated line subdividing the base; and a toothbrush;

placing the kit within a pocket;

transporting the kit to a washroom facility;

taking out the kit from the pocket;

bending the base along one of the serrated lines, wherein said bending step performed subsequent to said taking step;

tearing the base along the bent serrated line wherein said tearing step performed subsequent to said bending step;

pinching onto the cover with two fingers;

pealing off a portion of the cover while pinching onto the cover to expose one gelcap sequestered within one hollow well of the base;

removing the exposed gelcap from the base;

grasping onto the toothbrush;

pressing the exposed gelcap onto the toothbrush;

inserting a portion of the toothbrush with the gelcap pressed onto the toothbrush within a mouth of a user;

brushing a plurality of teeth within the mouth of the user with the inserted portion of the toothbrush wherein said brushing step performed subsequent to said inserting step;

expectorating any excess saliva wherein said expectorating step performed subsequent to said brushing step;

withdrawing the portion of the toothbrush from the mouth of the user, wherein said withdrawing step performed subsequent to said brushing step; and rinsing the withdrawn toothbrush with water.

* * * * *